US006745427B1

(12) United States Patent
Trenz et al.

(10) Patent No.: US 6,745,427 B1
(45) Date of Patent: Jun. 8, 2004

(54) BRUSH

(75) Inventors: Diethard Trenz, Ebenthal (AT); Markus Enzfellner, Ebenthal (AT)

(73) Assignee: Hagleitner Hygiene International GmbH, Zell am See (AT)

( * ) Notice: Subject to any disclaimer, the term of this patent is extended or adjusted under 35 U.S.C. 154(b) by 0 days.

(21) Appl. No.: 10/069,993

(22) PCT Filed: Aug. 30, 2000

(86) PCT No.: PCT/AT00/00235

§ 371 (c)(1),
(2), (4) Date: Mar. 1, 2002

(87) PCT Pub. No.: WO01/15587

PCT Pub. Date: Mar. 8, 2001

(30) Foreign Application Priority Data

Sep. 1, 1999 (AT) ..... 1507/99

(51) Int. Cl.[7] ..... A47K 17/00
(52) U.S. Cl. ..... 15/104.94; 15/164; 15/210.1
(58) Field of Search ..... 15/145, 160, 164, 15/176.1, 176.6, 210.1, 211

(56) References Cited

U.S. PATENT DOCUMENTS

| | | | | |
|---|---|---|---|---|
| 2,610,347 A | | 9/1952 | Kleiner | 15/210.1 |
| 2,666,223 A | | 1/1954 | Farrell | |
| 2,666,224 A | * | 1/1954 | Adams | 15/223 |
| 2,668,974 A | | 2/1954 | Jaeger | |
| 2,755,497 A | | 7/1956 | Greacen, Jr. | |
| 3,188,675 A | * | 6/1965 | Beck | 15/244.1 |
| 4,031,673 A | * | 6/1977 | Hagelberg | 451/517 |
| 4,457,038 A | | 7/1984 | Hammond | 15/145 |
| 4,987,634 A | * | 1/1991 | Weihrauch | 15/209.1 |
| 5,471,697 A | | 12/1995 | Daconta | 15/104.94 |
| 5,630,243 A | * | 5/1997 | Federico et al. | 15/104.94 |
| 5,875,512 A | * | 3/1999 | Lathan | 15/210.1 |
| 6,094,771 A | * | 8/2000 | Egolf et al. | 15/210.1 |
| 6,158,077 A | * | 12/2000 | Wenger et al. | 15/210.1 |
| 6,182,322 B1 | * | 2/2001 | Tubman | 15/172 |
| 6,507,972 B2 | * | 1/2003 | Hart | 15/210.1 |

FOREIGN PATENT DOCUMENTS

| | | | |
|---|---|---|---|
| DE | 33 20 586 A1 | | 12/1984 |
| DE | 85 210 62 U1 | | 2/1988 |
| DE | 92 019 32 U1 | | 11/1993 |
| JP | 8-112219 | * | 10/1994 |
| WO 220332/WO | 97/49314 | | 6/1997 |
| WOP9903352/WO | 97/49315 | | 6/1997 |

* cited by examiner

*Primary Examiner*—Terrence R. Till
(74) *Attorney, Agent, or Firm*—Lorusso Loud & Kelly LLP

(57) ABSTRACT

The invention relates to a brush, especially a toilet brush, comprising a brush head and a brush head holder, wherein the brush head can be detachably mounted on the brush head holder, especially in such a way that the two interlock. According to the invention, the brush head can be slid onto the brush head holder with a friction fit. It is therefore possible to exchange a used brush head for a new, germ-free replacement. This not only avoids the unattractive appearance that conventional brushes acquire after repeated use, but also prevents health risks to the user.

45 Claims, 6 Drawing Sheets

BRUSH

BACKGROUND OF THE INVENTION

The invention concerns a brush, in particular a toilet brush, with a brush head and a brush head holder, with the brush being mountable in detachable fashion on the brush head holder, preferably in a way so that it can be locked in place.

Traditional brushes, in particular toilet brushes, pose a hygienic problem since the brush head is a good nutritive medium for bacteria and fungi. In addition to the unattractive appearance of the brush after repeated use, this will lead to a health hazard for the user.

From DE 33 20 586 A1, a brush has been known that features a dual brush head, part of which is attached to the handle of the toilet brush, while the other part can be unscrewed and replaced. This design is based on the idea that the brush wears off more at the top part than at the rear end. But since only part of the brush head is always exchanged, the problem of bacteria formation persists. Sterility can not be achieved by this means. Also, in order to unscrew the front part of the brush, it must always be touched by hand, which is most unhygienic.

SUMMARY OF THE INVENTION

The invention at hand solves the aforementioned problems by providing a brush of the type cited at the beginning in which the brush head can be pushed onto the brush head holder by way of friction closure. This makes it possible to exchange the entire used brush head for a new sterile one. The used brush head does not need to be touched by hand, as will be shown below.

A particularly preferred model of the invention is characterized by the fact that the brush head is a disposable one-way brush head. This makes it possible in the case of toilet brushes to dispose of the brush head via the toilet without coming into direct contact with it.

In order to prevent the user from having to come into direct contact with the brush head, it is useful if the brush head holder features an ejection mechanism.

In a particularly advantageous model, the ejection mechanism of the brush consists of a sleeve sliding on a handle, with the sleeve preferably being movable by way of a push button. This eliminates the necessity of touching the brush head by hand.

Preferably, the push button will feature an extension that is directly or indirectly connected with the ejection mechanism. Said extension should be flexible so it can be used with a bent handle as well. Alternatively, in lieu of the extension, a wire can be connected directly or indirectly with the ejection mechanism. The bending of the handle allows hard-to-reach areas of toilet bowls and the like to be cleaned as well.

In order to assure a fixed connection between the brush head and the brush head holder, the brush head holder can be equipped with a locking mechanism. The latter comprises at least an extendable ball or an extendable cog.

A brush head to be utilized in the invention contains, for the purpose at hand, bristles made of degradable material, in particular paper. The bristles can be arranged on a mounting element, in particular a receiving sleeve made of degradable material, especially paper. A preferred model of the brush head is characterized by the fact that the receiving sleeve is designed as a hollow cylinder in order to be stuck onto a cylindrical section of the brush head holder.

A protective sleeve surrounding the bristles is provided in order to keep the bristles together prior to their first-time use.

A particularly advantageous manufacturing process by jet molding is made possible with regard to the brush head if the brush head is made of water-soluble plastic. The plastic material may be made from replenishable raw materials.

To achieve better cleaning, disinfection, and hygienic odors, the brush head may be impregnated with a cleaning and/or disinfection and/or scent agent, preferably in gel form.

BRIEF DESCRIPTION OF THE DRAWING

Now, the invention will be described in detail, using non-restricting sample models and making reference to the drawing. In the drawings, parts that are identical or identical in function are indicated by the same reference symbols.

DETAILED DESCRIPTION OF THE INVENTION

Figure 1:
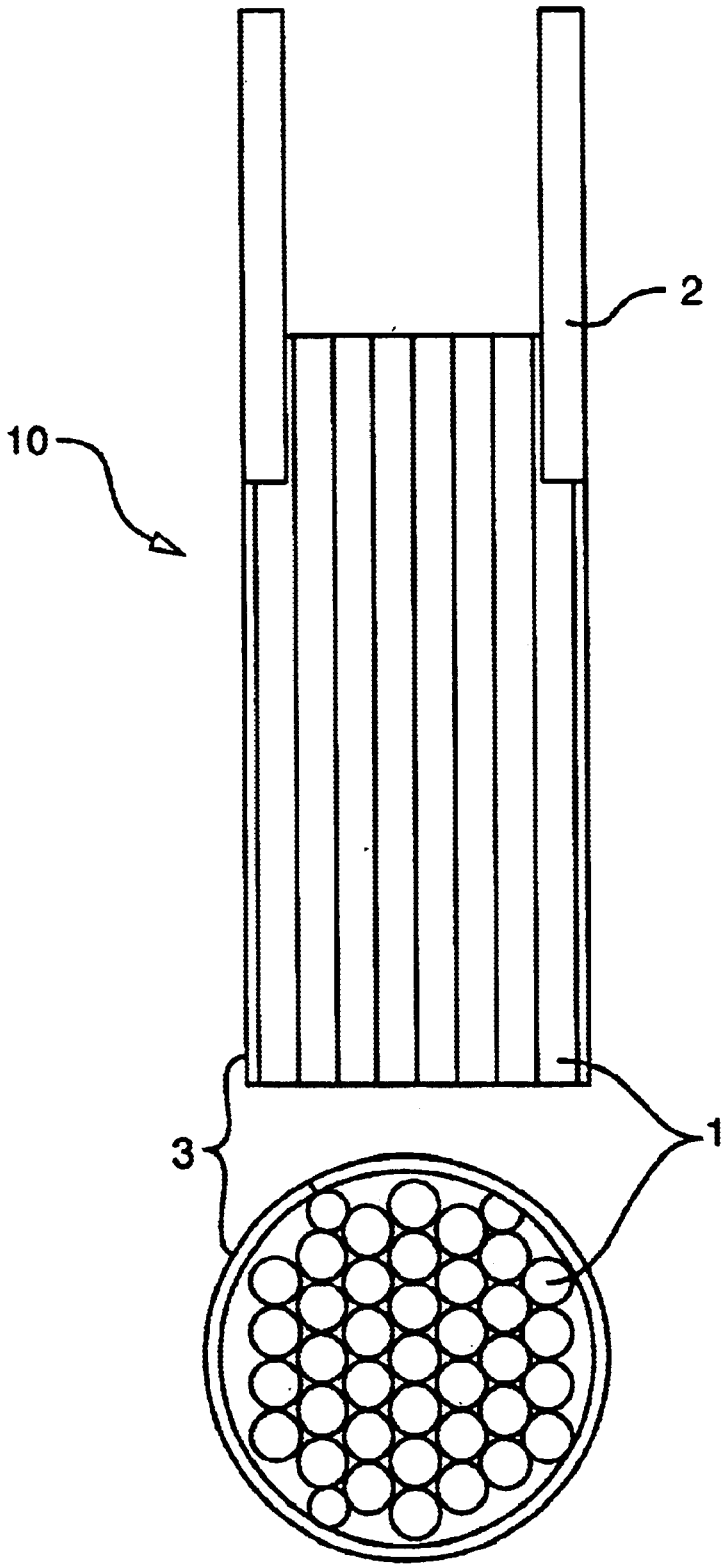
FIG. 1 shows a brush head according to the invention schematically in a longitudinal section and in a horizontal projection.
Figure 2:
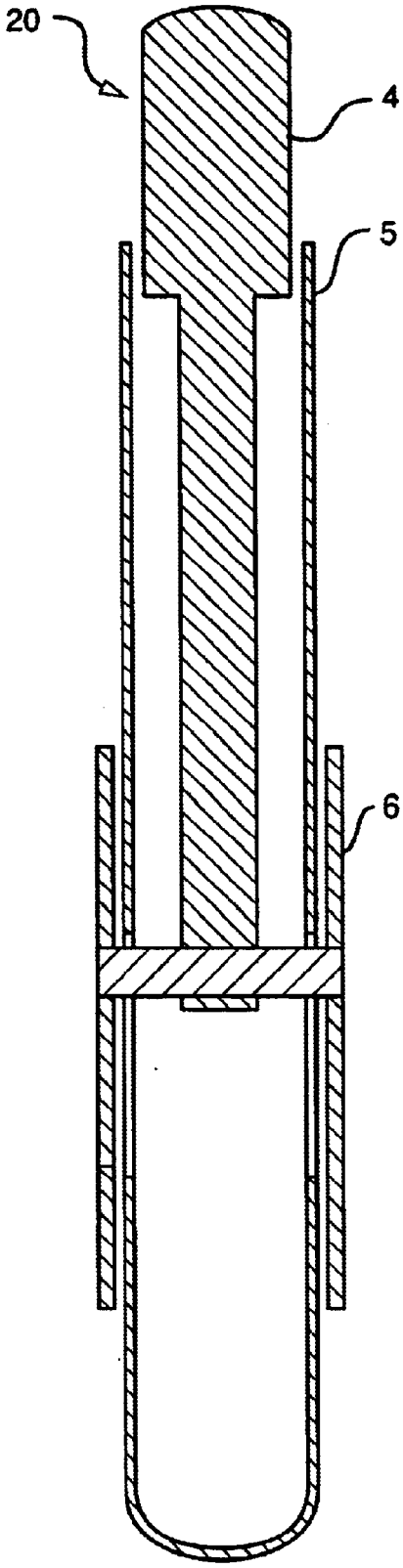
FIGS. 2 and 3 show two models of a brush head holder of the invention in a longitudinal section.
Figure 3:
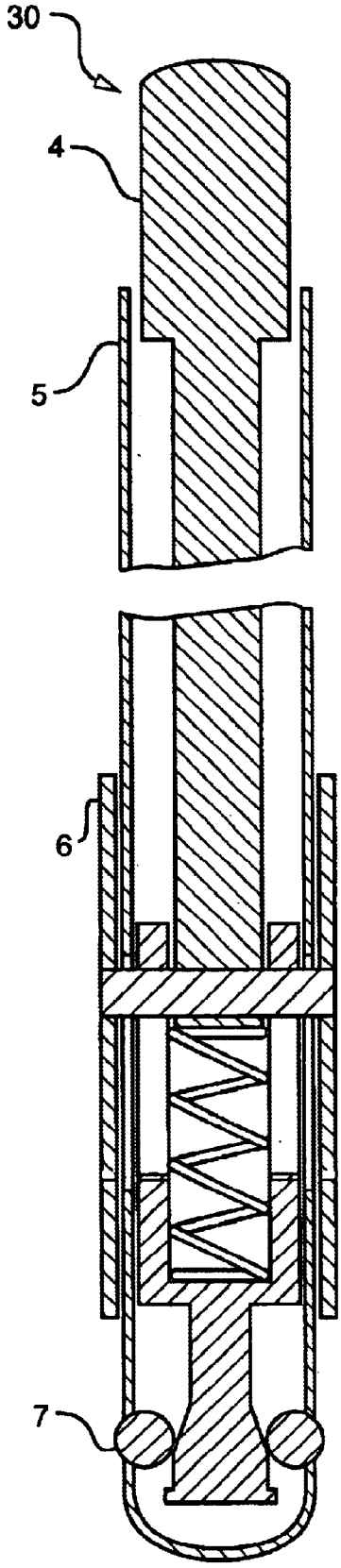

First, reference is made to FIGS. 1 through 3. The brush according to the invention, shown as executed as a toilet brush, consists of a brush head 10, as shown in FIG. 1, and a brush head holder as indicated in FIG. 2 in general by the number 20 and in FIG. 3 in general by the number 30. The brush head is executed as a one-way brush head and consists of a sleeve 2 that precisely fits the brush head holder 20, 30. If necessary, the sleeve 2 can be supplemented by an extension tube made of cellulose or the like in order to be able to effectively clean hard-to-reach places in toilet bowls, etc. Connected to the sleeve 2 are several rolled-up paper strips or similar that serve as bristles and that are held together by a protective cover 3. Prior to using the one-way brush, the protective cover 3 must be removed, allowing the bristles 1 of the brush head 10 to unfold. After use, the brush head can be thrown off by means of a push button 4 on the brush head holder 20, 30 and into the toilet bowl, and then disposed of. The brush heads of the invention consist of a well-degradable material, in particular a material that is easily soluble in water, e.g. one similar to toilet paper. Preferably, the brush heads are made of cellulose or a water-soluble plastic that can be made from replenishable raw materials. Such water-soluble plastic can be processed like normal plastic in jet moldings, but it has the advantage that the brush heads made of this material can also be disposed off via the toilet due to its water solubility. Furthermore, the brush head can be impregnated with scent, cleaning and/or disinfection agents, with these agents preferably being used in gel form.

The brush head holder 20, 30 consists of a handle 5 made of metal, PVC or similar that the brush heads are stuck onto. The brush head holder is equipped with a mechanism 6 that makes it possible to slide off the brush heads by means of the push button 4 on the handle. The brush head holder 30 according to FIG. 3 furthermore is equipped with a ball mechanism 7 that firmly locks the brush head in position after it has been stuck on. FIG. 2 shows a simpler solution provided for manual use by hand [sic]. However, the model according to FIG. 3 assures a better hold of the brush head on the brush holder and is intended for use with a one-way brush head dispenser.

Figure 7:
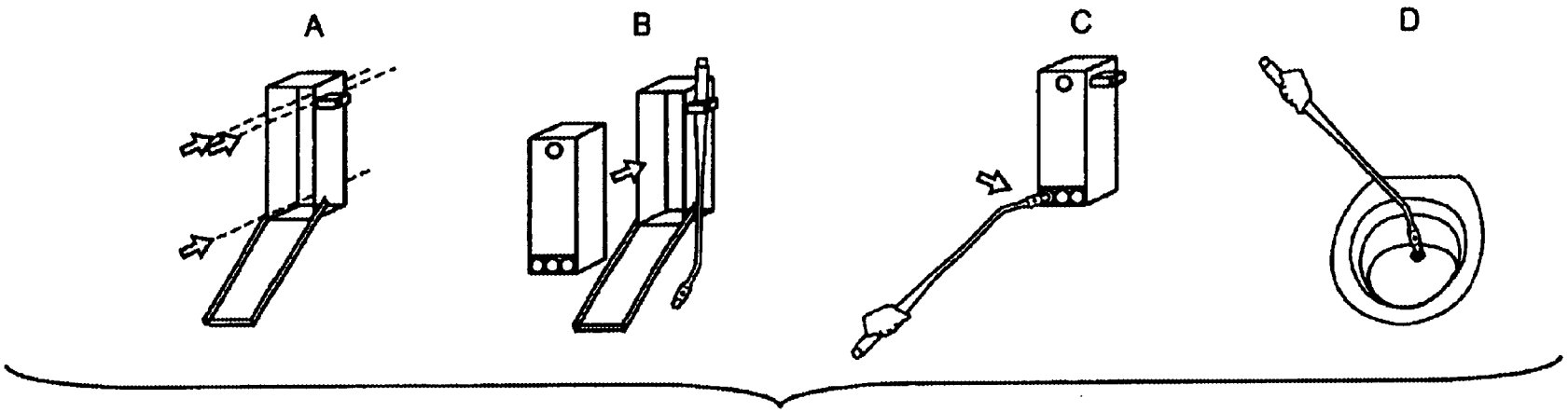
FIG. 7 shows in four models the utilization of the brush head holder together with a brush head dispenser.

Such a one-way brush head dispenser consists, e.g., of a storage container with several brush heads that drops in front of a removal opening by force of gravity or a spring. Several small knives may be arranged around the removal opening that tear open the protective cover of the brush head when it is pulled out of the removal opening. The brush head holder is stuck through the removal opening into the brush head and automatically locked in place by means of the ball mechanism. When the one-way brush is pulled out, the protective cover of the brush head is torn open and the one-way toilet brush is instantly ready to use. The process is shown in FIG. 7 in the sequence a) through d). In step a), a magazine for the storage container is first mounted on the wall with screws or, alternatively, with adhesive tape. The magazine has a front wall that can be folded out and whose lower end has an opening for the insertion of the brush head holder. In step b), the storage container is placed into the magazine, and it can be seen that the brush sits in a holder on the right side of the magazine. In step c), the brush head holder is stuck into a brush head, and the brush is thus ready to use. In step d), the cleaning process can now be carried out.

Figure 4:
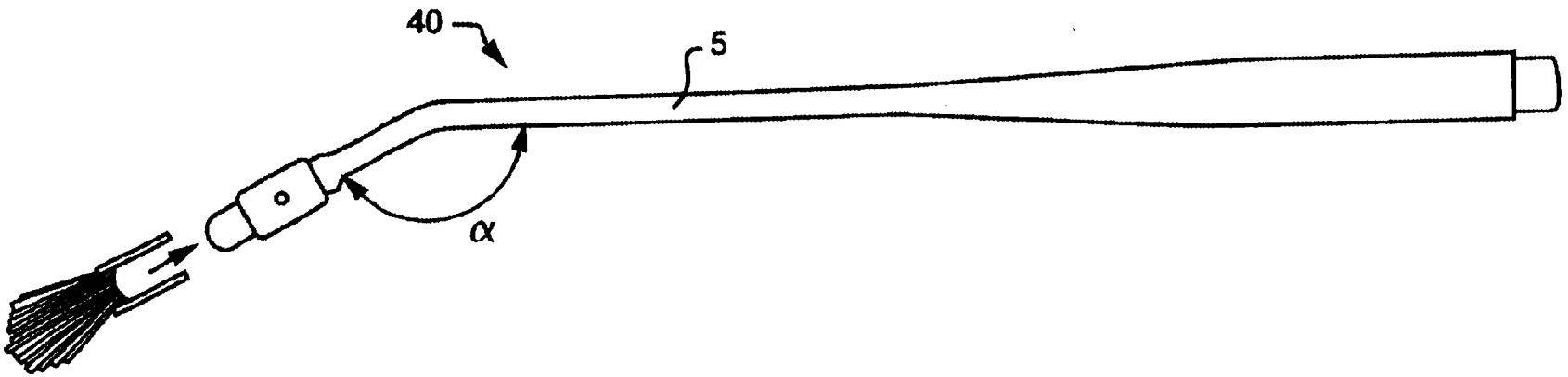
FIGS. 4 and 5 show an additional model of a brush head holder according to the invention in a lateral section and a longitudinal section.
Figure 5:
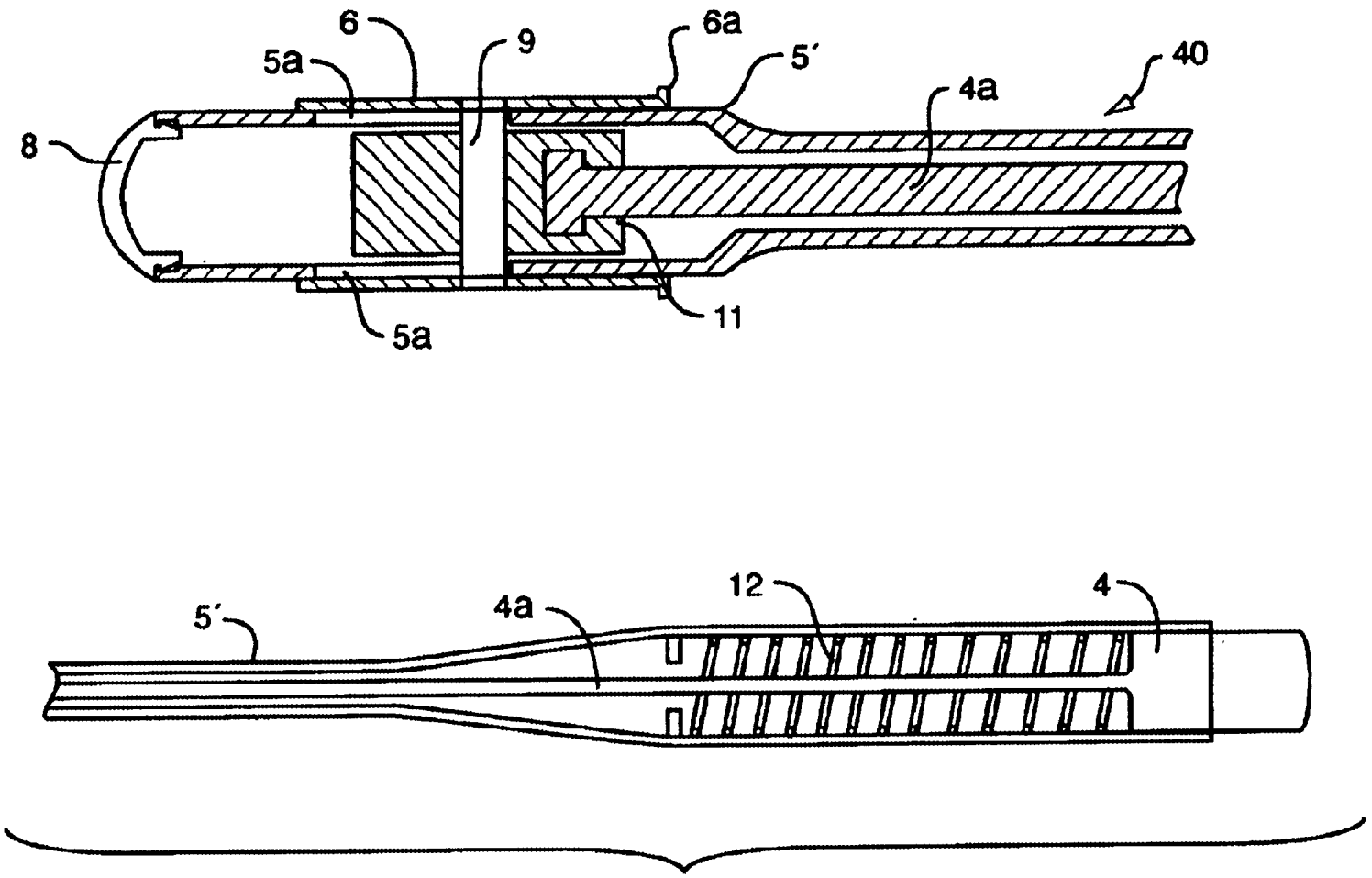

FIG. 4 shows an additional model of a brush head holder 40 according to the invention in a side view. It differs from the models described above in that the handle 5' is equipped with a bend $\alpha$ of approximately 155°. This makes it possible to clean hard-to-reach places in toilet bowls as well. FIG. 5 shows a longitudinal section through the brush head holder of FIG. 4 that, for space reasons, was separated into two segments. From FIG. 5, one can recognize additional differences of this model of the brush head holder vis-a-vis those of FIGS. 2 and 3. The brush head holder 40 features a movable connection element 11 split lengthwise at the end of the brush head side in the interior of the handle 5' that interlocks with a flexible (necessary due to the bend) extension 4*a* of the push button 4 and which transfers translation motions of the push button 4 to the sleeve-shaped ejection mechanism 6 via a bolt 9 that can slide in oblong slots 5*a* of the handle 5'. The ejection mechanism 6 features a flange 6*a* that serves as a stopper for the protective cover of the brush head. The protective paper cover is pushed back to said stopper. The spring 12 resets the push button 4 to its starting position. In addition, a cap 8 that can be forced on by pressure closes the tube-shaped handle 5' off.

Figure 6:
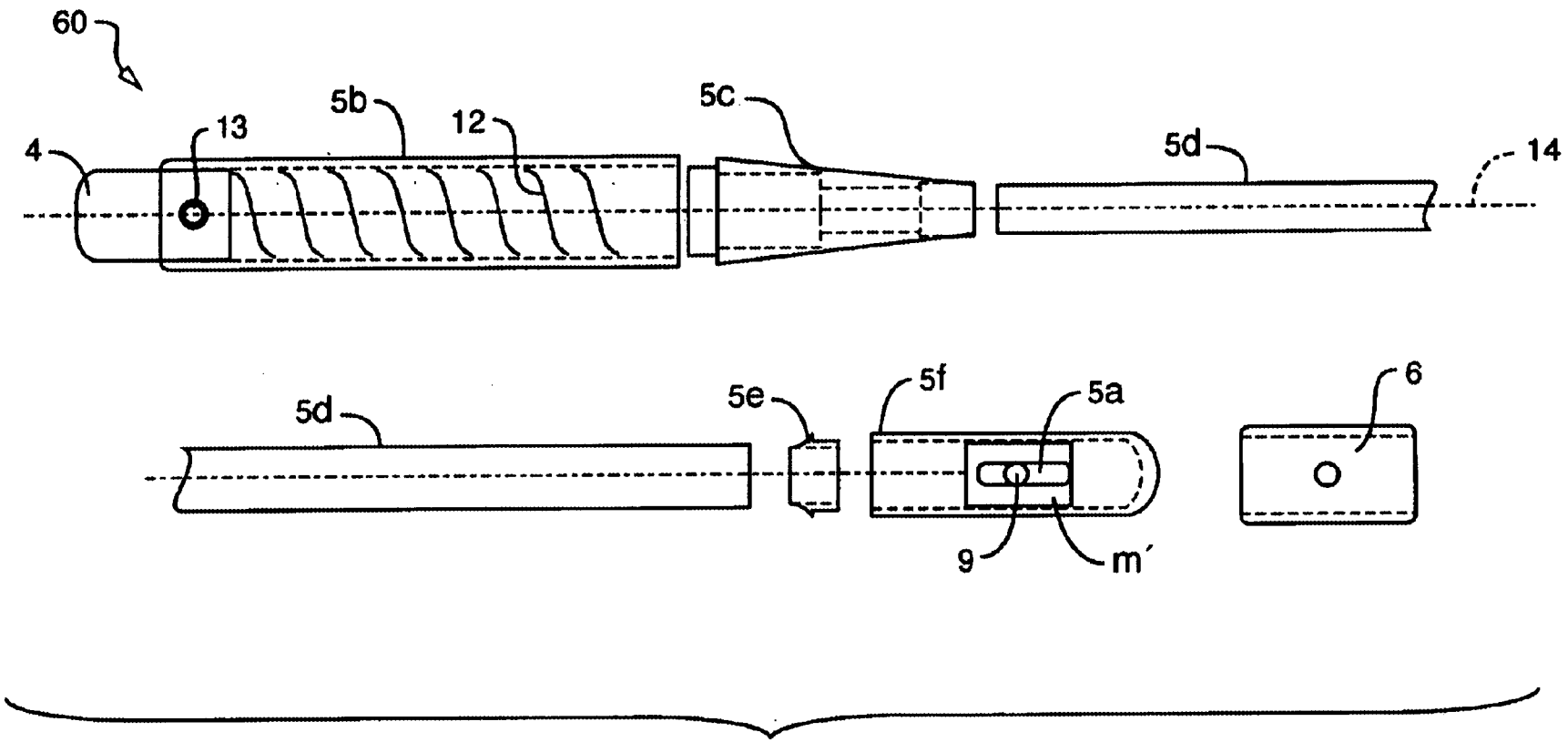
FIG. 6, again, shows a different brush head holder according to the invention in a longitudinal section.

Another model of a brush head holder 60 according to the invention is shown in FIG. 6. It differs from the design models of FIGS. 4 and 5 mainly in that the handle is composed of several parts, namely a grip part 5*b*, a cone part 5*c*, a connection tube 5*d*, another connection part 5*e* and a head part 5*f* that features the oblong slots 5*a* for the bolt 9 which traverses the connection part 11'. The ejection mechanism 6 is pushed over the head part 5*f*. The parts of the handle can be formed of plastic, preferably however of stainless steel, and are cemented together. In contrast with the previous model, the push button 4 does not feature an extension, but is connected, by means of a stud screw 13, to a relative stiff stainless-steel wire 14 whose other end locks into the connection part 11'. The wire 14 transmits the translation motions of the push button 4 to the connection part 11'. The spring 12 again serves to reset the push button 4 to its starting position. The connection tube 5*d* of the handle is bent prior to the assembly in order to create the aforementioned bend.

We claim:

1. A brush, in particular a toilet brush, comprising a disposable one-way brush head, a brush head holder with a handle, the brush head being detachably mounted to the brush head holder under friction closure, and an ejection mechanism for the brush head, the ejection mechanism comprising a sleeve-shaped ejection member movable along the brush head holder, an actuator element movably arranged on the handle, and a motion transfer element between the actuator element and the sleeve-shaped ejection member, wherein the motion transfer element extends in the interior of the handle.

2. The brush according to claim 1, wherein the brush head holder comprises oblong slots and the motion transfer element comprises a connection element movable in the brush head holder, the sleeve-shaped ejection member being connected to the connection element via a bolt sliding in the slots.

3. The brush according to claim 1, wherein the motion transfer element is an extension of the actuator element.

4. The brush according to claim 1, wherein the motion transfer element is a rod-shaped element.

5. The brush according to claim 1, wherein the handle features a bend and the motion transfer element is flexible.

6. The brush according to claim 5, wherein the motion transfer element is a wire.

7. The brush according to claim 1, wherein the brush head comprises bristles made of a degradable material.

8. The brush according to claim 7, wherein the bristles are made of paper.

9. The brush according to claim 7, wherein the bristles are arranged in a receiving sleeve made of degradable material.

10. The brush according to claim 9, wherein the receiving sleeve is made of paper.

11. The brush according to claim 9, wherein the brush head holder has a cylindrical end section, and wherein the receiving sleeve is designed as a hollow cylinder stuck onto the cylindrical end section.

12. The brush according to claim 7, wherein a protective sleeve surrounding the bristles is provided.

13. The brush according to claim 1, wherein the brush head is made of water-soluble plastic.

14. The brush according to claim 1, wherein the brush head is impregnated with at least one agent.

15. The brush according to claim 14, wherein the agent is selected from the group consisting of a cleaning agent, a disinfecting agent and a scent agent.

16. A brush, in particular a toilet brush, comprising a disposable brush head made of a degradable material, a brush head holder with a handle featuring a bend, the brush head being detachably mounted to the brush head holder under friction closure, and an ejection mechanism for the brush head, the ejection mechanism comprising a sleeve-shaped ejection member movable by means of an actuator element, wherein the brush head comprises bristles arranged in a receiving sleeve the receiving sleeve being mountable to the brush head holder.

17. The brush according to claim 16, wherein the bend is near the brush head.

18. The brush according to claim 16, wherein the bend comprises an angle of approximately 155°.

19. The brush according to claim 16, wherein the actuator element is connected with the ejection mechanism via a wire.

20. The brush according to claim 16, wherein the brush head is made of papper.

21. The brush according to claim 16, wherein the brush head is made of water-soluble plastic.

22. The brush according to claim 16, wherein the brush least one agent.

23. The brush according to claim 22, wherein the agent is selected from the group consisting of a cleaning agent, a disinfecting agent and a scent agent.

24. A brush, in particular a toilet brush, comprising a brush head, a brush head holder with a handle, the brush head being detachably mounted to the brush head holder under friction closure, and an ejection mechanism for the brush head, the handle being composed of several parts cemented together, wherein said several parts comprise a grip part, a cone part, a connection tube, a connection part, the connection part being connected with the brush head holder, an actuator element movably arranged on the grip part, and a motion transfer element between the actuator element and the ejection mechanism, the motion transfer element being slidingly arranged in the connection tube.

25. The brush according to claim 24, wherein the parts of the handle are made of plastic material.

26. The brush according to claim 24, wherein the parts of the handle are made of stainless steel.

27. The brush according to claim 24, wherein the connection tube comprises a bend.

28. The brush according to claim 24, wherein the brush head is a disposable brush head made of a degradable material.

29. The brush according to claim 28, wherein the brush head is made of paper.

30. The brush according to claim 28, wherein the brush head comprises bristles arranged in a receiving sleeve, the receiving sleeve being mountable to the brush head holder.

31. The brush according to claim 24, wherein the brush head is made of water-soluble plastic.

32. The brush according to claim 24, wherein the brush head is impregnated with at least one agent.

33. The brush according to claim 32, wherein the agent is selected from the group consisting of a cleaning agent, a disinfecting agent and a scent agent.

34. A disposable brush head for a toilet brush with a brush head holder, the brush head being detachably mountable to the brush head holder under friction closure, the brush head comprising bristles arranged in a receiving sleeve, the receiving sleeve being mountable to the brush head holder, wherein the bristles and the receiving sleeve are made of degradable material.

35. The brush head according to claim 34, wherein the bristles are made of paper.

36. The brush head according to claim 34, wherein the receiving sleeve is made of paper.

37. The brush head according to claim 34, wherein the receiving sleeve is designed as a hollow cylinder mountable to a cylindrical end section of the brush head holder.

38. The brush head according to claim 34, wherein a protective sleeve surrounding the bristles is provided.

39. The brush head according to claim 34, wherein the brush head is made of water-soluble plastic.

40. The brush head according to claim 34, wherein the brush head is impregnated with at least one agent.

41. The brush head according to claim 40, wherein the agent is selected from the group consisting of a cleaning agent, a disinfecting agent and a scent agent.

42. A brush, in particular a toilet brush, comprising a disposable brush head made of a degradable material and a brush head holder with a handle featuring a bend, the brush head being detachably mounted on the brush head holder, wherein the brush head comprises bristles arranged in a receiving sleeve, the receiving sleeve being mountable to the brush head holder.

43. A brush, in particular a toilet brush, comprising a brush head made of a degradable material and a brush head holder with a handle, the brush head detachably mounted on the brush head holder comprising an ejection mechanism, the handle being composed of several parts cemented together, wherein the brush head comprises bristles arranged in a receiving sleeve, the receiving sleeve being mountable to the brush head holder.

44. A disposable brush head for a toilet brush with a brush head holder, the brush head being detachably mountable to the brush head holder under friction closure, the brush head comprising bristles arranged in a receiving sleeve, the receiving sleeve being mountable to the brush head holder, wherein a protective sleeve surrounding the bristles is provided.

45. A disposable brush head for a toilet brush with a brush head holder, the brush head being detachably mountable to the brush head holder under friction closure, the head comprising bristles arranged in a receiving sleeve, the receiver sleeve being mountable to the brush head holder, wherein the brush head is made of water-soluble plastic.

* * * * *